United States Patent [19]

Kii

[11] 4,242,550

[45] Dec. 30, 1980

[54] CIRCUIT INTERRUPTER OF THE TYPE PRODUCING A PUFF OF ARC EXTINGUISHING GAS UPON OCCURRENCE OF AN ARC

[75] Inventor: Masami Kii, Amagasaki, Japan

[73] Assignee: Mitsubishi Denki Kabushiki Kaisha, Tokyo, Japan

[21] Appl. No.: 919,452

[22] Filed: Jun. 27, 1978

[30] Foreign Application Priority Data

Jun. 27, 1977 [JP] Japan ..... 52/76734
Aug. 30, 1977 [JP] Japan ..... 52/104474

[51] Int. Cl.[3] ..... H01H 33/88

[52] U.S. Cl. ..... 200/148 R; 200/148 A; 200/150 G

[58] Field of Search ..... 200/148 R, 148 A, 148 B, 200/148 C, 148 D, 148 E, 148 F, 148 G, 148 H, 148 J, 148 BV, 150 G

[56] References Cited

U.S. PATENT DOCUMENTS 2,957,063 10/1960 Leeds ..... 200/148 A
3,551,626 12/1970 Millianowicz ..... 200/148 A

OTHER PUBLICATIONS

Japanese Unexamined Utility Model Publication Number 29345/1972.
Japanese Unexamined Utility Model Publication Number 42465/1974.

*Primary Examiner*—J. V. Truhe
*Assistant Examiner*—Morris Ginsburg
*Attorney, Agent, or Firm*—Oblon, Fisher, Spivak, McClelland & Maier

[57] ABSTRACT

A circuit interrupter comprises a pair of contacts movable relative to one another into a separated or spaced apart position in a chamber containing a fluid for arc extinction, and includes a pressure chamber for storing the fluid for arc extinction which is pressurized by arcing occurring in the space between separating contacts. Structure is provided in association with the pressure chamber for preliminarily pressurizing the fluid depending upon the extent of movement of the contacts in a separating direction prior to separation thereof, and wherein an outlet from the chamber is opened after the contacts have separated, and the fluid for arc extinction in the pressure chamber is thus discharged through the arc space and the arc is interrupted by puffing of the fluid through the arc for arc extinction.

8 Claims, 2 Drawing Figures

CIRCUIT INTERRUPTER OF THE TYPE PRODUCING A PUFF OF ARC EXTINGUISHING GAS UPON OCCURRENCE OF AN ARC

BACKGROUND OF THE INVENTION

1. Field of the Invention

The present invention relates to a circuit interrupter for performing arc extinction by puffing a fluid for arc extinction, such as $SF_6$ gas. More particularly, it relates to a self arc extinction type circuit interrupter in which high pressure fluid whose pressure is raised by an arc formed between a pair of contacts is used for performing the arc extinction.

2. Description of the Prior Art

In conventional circuit interrupters, a fluid in a suitable volumetric space is pressurized by the pressurizing effect of arc energy transmitted from the arc to the fluid, and the pressurized fluid is released from an opening closed by the arc through the arc space under periodical change of the arc current, and the arc extinction is attained by the resulting puffing effect and cooling effect of the pressurized fluid.

In such self arc extinction type circuit interrupters, it is clear that the pressurizing function is important and indispensable. The pressurizing function is dependant upon the arc energy. Accordingly, the pressurizing function can be easily obtained in a zone having a large arc current, whereas it is difficult to obtain the pressure required for the arc extinction in a zone having a small arc current because the arc energy is significantly small and the pressurizing function is low. Accordingly, there is a zone for a significantly small arc extinction. This phenomenon is a serious disadvantage for using such circuit interrupters in high voltage fields, though it has a significant advantage in large current fields.

In order to effectively imparting the puffing effect and the cooling effect given by releasing the high pressure source onto the arc zone or area, it is necessary to rapidly discharge the arc energy provided in the arc space without leaving the fluid in the arc space too long and to prevent excessive elevation of the temperature of the fluid in the arc space, thereby preventing ionization of the fluid by the arc.

SUMMARY OF THE INVENTION

It is an object of the present invention to overcome these disadvantages and to decrease the volume of space for the high pressure fluid source prior to an arcing between contacts and to rapidly form a high pressure fluid source by increasing the fluid density and to improve the arc extinction characteristic and to stabilize it by increasing the pressure difference and heat discharge.

Another object of the present invention is to provide a circuit interrupter which has excellent arc extinction characteristics over a wide range of current values and which has high arc extinction characteristics even in large current zones and has excellent performance for self arc extinction type circuit interrupters and has a compact and simple structure to attain a stable function with a small operating power.

Various other objects, features and attendant advantages of the present invention will be more fully appreciated as the same becomes better understood from the following detailed description when considered in connection with the accompanying drawings in which like reference characters designate like or corresponding parts throughout the several views.

BRIEF DESCRIPTION OF THE DRAWINGS

In the drawings, like reference numerals designate identical or corresponding parts.

DETAILED DESCRIPTION OF THE PREFERRED EMBODIMENTS

Figure 1:
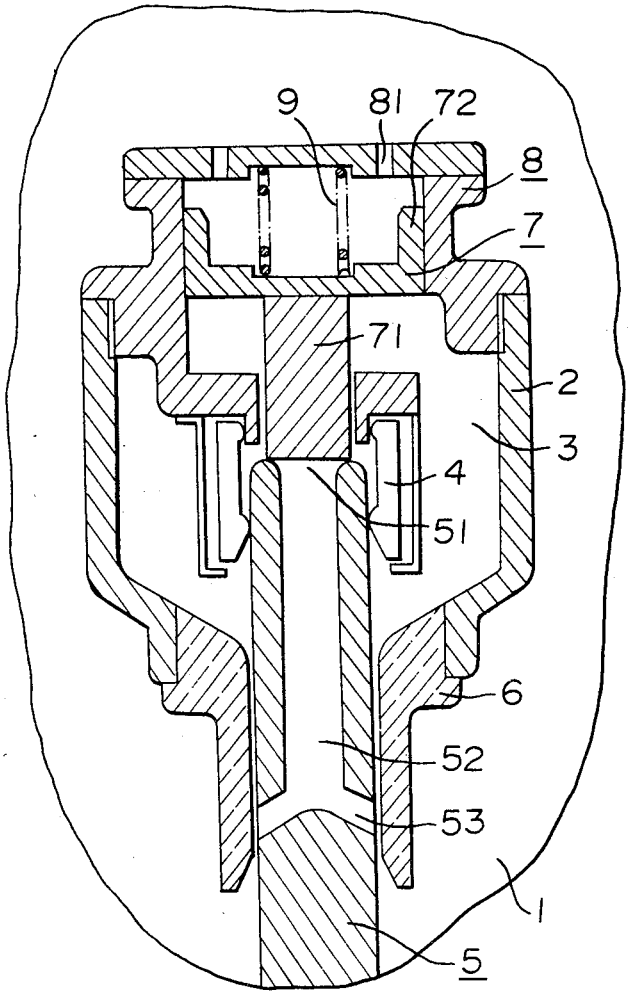
FIG. 1 is an enlarged sectional view of one embodiment of a circuit interrupter according to the present invention.

Referring to the drawings, one embodiment of the present invention will be illustrated in detail in FIG. 1, wherein the reference numeral (1) designates a container filled with a fluid for arc extinction, such as $SF_6$ gas; (2) designates a body of the circuit interrupter which is disposed in the container and in which the fluid for arc extinction is filled and which forms an arc extinguishing chamber (3) having suitable space for temporarily storing a pressurized fluid formed by a pressurizing function of the arc; (4) designates a fixed contact disposed in the arc extinguishing chamber (3); (5) designates a movable contact which has an inlet (51) for the fluid for arc extinction, a passage (52) and an outlet (53) and which is adopted to be separable from the fixed contact (4); (6) designates a shell which is connected to the body at the bottom of the arc extinguishing chamber (3) in surrounding relation to the movable contact (5) and in which the arc space is formed to guide the flow of the fluid; (7) designates a piston disposed in the arc extinguishing chamber (3) comprising a projecting part (71) contacting with the movable contact (4) and a movable piston body (72) inwardly contacting with a cylinder (8) having an opening (81); (9) designates a spring pushing the piston (7) in a direction for contacting it with the movable contact (5). The piston (7) is lifted to compress the spring (9) when the contacts (4) and (5) are closed and the piston (7) is descended for a desirable distance just before the contacts (4) and (5) separate to raise the pressure in the arc extinguishing chamber (3) to a specific pressure so as to increase the density of the fluid as desired.

A command for separating the contacts is applied to an operating device (not shown) in such structure, whereby the movable contact (5) is descended depending upon the command. The piston (7) is descended by the spring, depending upon the descending operation of the movable contact (5), whereby the pressure and density of the fluid in the arc extinguishing chamber (3) are correspondingly increased. When the movable contact (5) is further descended beyond a preliminary wiping distance until the movable contact (5) separates from the fixed contact (4), the arc is formed between the contacts (4) and (5). In this condition, the operation of the piston (7) is stopped. On the other hand, the arc is extended depending upon further descending movement of the movable contact (5), whereby the fluid in the arc extinguishing chamber (3) is rapidly pressurized. When the pressure in the arc extinguishing chamber (3) rises as desired, and the outlet (53) is opened to the container (1) during decreasing of the arc current to zero, the arc extinction is performed by significant puffing effect and cooling effect of the high pressure fluid.

In such case, the density of the fluid in the arc extinguishing chamber (3) is previously increased by the effect of the piston (7), whereby the fluid pressurizing function by the arc in the high density fluid is further effectively attained and the fluid for arc extinction is compressed for a short time to the pressure required for puffing.

The heat capacity of the fluid in the arc extinguishing chamber (3) is increased because of high density of the fluid whereby the elevation of the temperature can be decreased to a lower temperature of the fluid in puffing. Moreover, the puffing effect and cooling effect are increased, depending upon the increase of density of the fluid for arc extinction in puffing, whereby the pressure of the fluid filled in the container (1) can be decreased and the structure of the container can be simplified and the characteristics can be improved and the size of the circuit interrupter can be compact.

The arc extinguishing chamber (3) is pressurized in comparison with that of the container (1) before separating the contacts, whereby the pressure required for the operation can be obtained even though the arc current is significantly small so that a low pressurizing function would be otherwise achieved. Moreover, the desirable characteristics can be attained without operating the movable contact (5) at high speed even though the circuit interruption is carried out in a high voltage circuit or in a small current delay circuit having high restriking voltage rising coefficient.

When the compressing device comprising the cylinder (8) and the piston (7) is replaced with a bellows type device having no mechanical sliding part, the operation of the piston (7) can be stable to prevent leakage, and the characteristics of the device can be improved by a simple structure.

In order to prevent reverse operation or movement of the piston (7) upon increasing pressure in the arc extinguishing chamber (3) over the specific level, it is further advantageous to provide a blocking means for preventing a reverse current of the pressurized fluid from the arc extinguishing chamber to the cylinder (8) in the condition of descending movement of the piston (7).

In accordance with the circuit interrupter of the present invention, the characteristics can be improved in a simple structure because the arc extinguishing chamber comprises a pair of contacts separable from each other, and the fluid for arc extinction which is pressurized by the arc formed between the contacts and the fluid in the arc extinguishing chamber is preliminary compressed depending upon the movement of the contacts in a separating direction.

Figure 2:
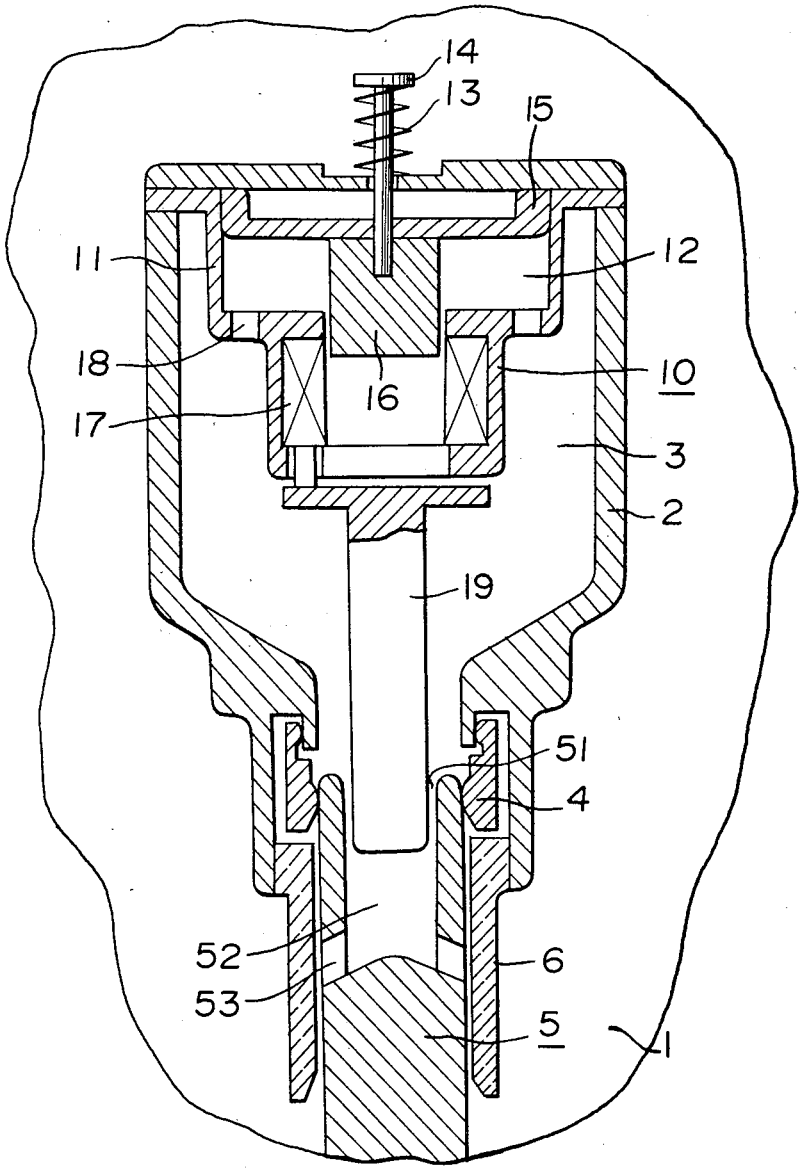
FIG. 2 is an enlarged sectional view of another embodiment of a circuit interrupter according to the present invention.

FIG. 2 shows the other embodiment of the present invention wherein the reference numeral (1) designates a container filled with a fluid for arc extinction, such as $SF_6$ gas; (2) designates a body of the circuit interrupter which is disposed in the container and in which the fluid for arc extinction is filled and which forms an arc extinguishing chamber (3) having suitable space for temporarily storing a pressurized fluid formed by a pressurizing function of the arc; (4) designates a fixed contact disposed in the arc extinguishing chamber (2); (5) designates a movable contact which has an inlet (51) for the fluid for arc extinction, a passage (52) and an outlet (53) and which is adopted to be separable from the fixed contact (4); (6) designates an insulting shell which is connected with the body (2) at the bottom of the arc extinguishing chamber (3) in surrounding relation to the movable contact (5) and in which the arc space is formed; (10) designates a compressing device disposed in the chamber (3) and the compressing device (10) comprises a cylinder chamber (12) formed in a frame (11) mounted on the body (2) in one piece; a movable piston (15) normally held at the upper position in the cylinder chamber (12) via a rod (14) and compressed spring (13), and an excitation coil (17) mounted on the frame (11) for generating electromagnetic attractive force depending upon the current, to a movable iron core (16) mounted on one end of the rod (14).

The reference numeral (18) designates a hole communicating the cylinder chamber (12) to the chamber (3) formed in the frame (11); (19) designates an arc electrode whose one end is electrically connected to the excitation coil (17) and whose other end faces to the movable contact (5).

A command for separating the contacts is applied to an operating device (not shown) in such structure, whereby the movable contact (5) is descended depending upon the command.

When the movable contact (5) is descended for a wiping distance relative to the fixed contact (4) and the movable contact (5) is further descended, the current is commutated between the movable contact (5) and the arc electrode (19). At this moment, the movable contact (5) is departed from the fixed contact (4) for a suitable distance. The current commutated to the arc electrode (19) is passed through the excitation coil (17), whereby the current circuit is formed by frame (11), excitation coil (17), arc electrode (19) and movable contact (5).

When the circuit is formed and the current is passed through the excitation coil (17), the magnetic driving force for the movable iron core (16) is generated, whereby the movable piston (15) is downwardly moved against the spring (13) and the fluid in the cylinder (12) is passed through the hole (18) to the chamber (3) and the fluid in the chamber (3) is thus compressed. The degree of the compression can be controlled depending upon a ratio of the volume of the chamber (3) to the variable volume of the cylinder chamber (12). The driving force of the movable iron core (16) can be attained by selecting the windings of the excitation coil (17) as desired. A further commutating can be accomplished as follows:

The arc voltage is increased depending upon descending the movement of the movable contact (5) after forming a small arc by separating the movable contact (5) from the fixed contact (4). Accordingly, the commutation can be attained by forming the distance between the arc electrode (19) and the movable contact (5) significantly smaller than the distance between the movable contact (5) and the fixed contact (4) in said condition.

When the movable contact (5) is further descended, the arc between the movable contact (5) and the arc electrode (19) is extended and the outlet (53) is passed over the end of the shell (6) whereby the fluid is discharged into the container (1). When the arc current is relatively small and the pressurizing function is not so high, the pressure in the chamber (3) is raised by the compressing device (10).

The pressure required for the arc extinction can be given by the pressurizing function of the arc itself in a large current case.

The resulting high pressure fluid is applied to the arc depending upon decreasing the arc current whereby the arc extinction is performed by rapidly puffing and cooling in the arc space.

In accordance with the present invention, stable and excellent characteristics can be obtained because the electromagnetic force resulted by the switching current is utilized to actuate the pressure compensation means depending upon the switching operation so as to provide the pressure required for the puffing, and accordingly, the pressure required for the puffing in all ranges of the current can be obtained.

Obviously many modifications and variations of the present invention are possible in light of the above teachings. It is therefore to be understood that within the scope of the appended claims the invention may be practiced otherwise than as specifically described herein.

What is claimed is:

1. A circuit interrupter which comprises:

a pair of interengaged contacts being relatively movable into a spaced apart position in a fluid for arc extinction;

an arc space formed by the separation of the contacts;

a chamber connected to the arc space to store the fluid for arc extinction pressurized in the arc space;

an outlet for discharging the fluid in the chamber through the arc space out of the chamber after separation of the contacts for a specific distance; and means for precompressing the fluid for arc extinction in the chamber dependent upon movement of the contacts in a direction for separation thereof.

2. A circuit interrupter according to claim 1, wherein the precompressing means comprises:

a piston being movable to decrease the volume of the chamber dependent upon movement of the contacts in a direction for separation thereof; and the piston is disposed in the chamber.

3. A circuit interrupter according to claim 2, wherein:

a spring is connected with the piston, biasing it in a direction for compressing the fluid for arc extinction, and the piston is kept in a predetermined position by the movable contact, against the biasing action of the spring in the closed state of the contacts; and the piston is moved by the spring upon movement of the contacts in a separating direction.

4. A circuit interrupter according to claim 1, wherein the precompressing means comprises:

an excitation coil which is connected to a current passage forming the arc generated by the separating contacts, and which forms an electromagnetic attractive force depending upon the current passed through the current passage;

a piston carrying a movable iron core for receiving the electromagnetic attractive force of the excitation coil;

a cylinder in which the piston is movable; and the fluid for arc excitation is compressed in the cylinder by the movement of the piston and is fed into the chamber.

5. A circuit interrupter according to claim 4, wherein:

the cylinder is disposed in the chamber and has a hole establishing communication with the chamber.

6. A circuit interrupter according to claim 4, wherein:

the excitation coil is connected to an arc electrode commutating the current after separation of the contacts.

7. A circuit interrupter according to claim 1, wherein:

the outlet is formed in one of the contacts; and an insulating shell having a length for maintaining the closed condition of the outlet until the contact is moved for a specific distance extends around the outlet in closing relationship thereto.

8. A circuit interrupter according to claim 7, wherein:

the movable contact is hollow and forms a passage which communicates the outlet with the arc space.

* * * * *